US008348067B2

(12) United States Patent
Brown

(10) Patent No.: US 8,348,067 B2
(45) Date of Patent: Jan. 8, 2013

(54) FINGERNAIL COLOR DISPLAY DEVICE

(76) Inventor: Shahnaz Mir Brown, Del Mar, CA (US)

( * ) Notice: Subject to any disclaimer, the term of this patent is extended or adjusted under 35 U.S.C. 154(b) by 459 days.

(21) Appl. No.: 12/510,165

(22) Filed: Jul. 27, 2009

(65) Prior Publication Data

US 2011/0017685 A1 Jan. 27, 2011

(51) Int. Cl.

| | |
|---|---|
| ***A47F 1/04*** | (2006.01) |
| ***A47F 7/00*** | (2006.01) |
| ***A45D 29/00*** | (2006.01) |
| ***B65D 85/20*** | (2006.01) |

(52) U.S. Cl. ..... 211/60.1; 211/13.1; 132/73; 206/443; 206/581

(58) Field of Classification Search ..... 211/13.1, 211/33, 37, 60.1, 62, 65, 68, 69, 70.6, 74, 211/85.1, 85.13, 85.2, 85.5, 85.9, 128.1, 211/133.1; 248/346.01, 519; 206/443, 581; 132/73, 73.5, 75; D28/61, 73

See application file for complete search history.

(56) References Cited

U.S. PATENT DOCUMENTS

| | | | | | |
|---|---|---|---|---|---|
| 410,175 | A | * | 9/1889 | MoAlister | 223/106 |
| 1,341,848 | A | * | 6/1920 | Haensler | 211/69 |
| 2,626,062 | A | * | 1/1953 | Manzella | 211/59.1 |
| D205,745 | S | * | 9/1966 | Nannfeldt | D6/469 |
| 3,300,055 | A | * | 1/1967 | Rohr | 211/74 |
| 3,638,664 | A | * | 2/1972 | Cohn | 132/314 |
| 3,935,944 | A | * | 2/1976 | Wilson et al. | 206/569 |
| 3,948,396 | A | * | 4/1976 | Upton et al. | 211/59.1 |
| 4,068,760 | A | * | 1/1978 | Johnson, Jr. | 211/74 |
| 4,103,145 | A | * | 7/1978 | Oliveri | 219/222 |
| 4,397,395 | A | * | 8/1983 | McKelvey | 211/69 |
| 4,411,868 | A | * | 10/1983 | Noack | 422/562 |
| D295,704 | S | * | 5/1988 | Despres | D6/469 |
| 5,190,169 | A | * | 3/1993 | Sincock | 211/60.1 |
| D351,745 | S | * | 10/1994 | Seifert | D6/415 |
| 5,579,929 | A | * | 12/1996 | Schwartz | 211/74 |
| 5,755,325 | A | * | 5/1998 | Willhite et al. | 206/443 |
| 5,823,363 | A | * | 10/1998 | Cassel | 211/60.1 |
| 5,850,917 | A | * | 12/1998 | Denton et al. | 206/366 |
| 5,904,149 | A | * | 5/1999 | Ruhl et al. | 132/73 |
| D416,405 | S | * | 11/1999 | Thoesen | D6/469 |
| 6,085,916 | A | * | 7/2000 | Kovacevic et al. | 211/86.01 |
| 6,349,827 | B1 | * | 2/2002 | Feder | 206/373 |
| 6,354,447 | B1 | * | 3/2002 | Brown | 211/60.1 |
| 6,450,330 | B1 | * | 9/2002 | Cannata | 206/303 |
| 6,603,550 | B1 | * | 8/2003 | Flynn et al. | 356/402 |
| 6,675,493 | B1 | * | 1/2004 | Martin | 34/240 |
| 7,237,683 | B1 | * | 7/2007 | Hammers | 211/13.1 |
| D618,280 | S | * | 6/2010 | Siegel | D19/85 |
| 2003/0116516 | A1 | * | 6/2003 | Belokin et al. | 211/69.5 |

* cited by examiner

*Primary Examiner* — Darnell Jayne
*Assistant Examiner* — Joshua Rodden
(74) *Attorney, Agent, or Firm* — John R. Ross; John R. Ross, III

(57) ABSTRACT

A fingernail color display system. Holding rods having a fingernail color display element are inserted into a display device. The display device has a side section and a top section. The side section provides support for the top section. The top section has holes arranged in rows. Rod support sections are attached to the underside of the top section so that there are rows of the rod support sections. The holding rods are inserted through the holes and are supported by the rod support sections to display the holding rods so that a rearmost row is higher than a frontmost row. In a preferred embodiment the display device is injection molded. Also preferably the top section is tilted with respect to horizontal and the rod support sections are of equal length. Also preferably the rod support sections include an alignment feature for aligning the holding rods so that the color display element is flush with the front edge of the display device.

4 Claims, 5 Drawing Sheets

PRIOR ART

FINGERNAIL COLOR DISPLAY DEVICE

The present invention relates to display devices, and in particular, to display devices for displaying the color of fingernail polish.

BACKGROUND OF THE INVENTION

Injection Molding Process

The process of injection molding is well known in the prior art. Injection molding is a manufacturing process for producing parts from both thermoplastic and thermosetting plastic materials. A prior art injection molding machine is shown in FIG. 1. Plastic pellets 1 are fed into hopper 2. Reciprocating screw 3 conveys the pellets to the right through barrel 4. Barrel 4 is heated by heater 5. The heat from barrel 4 and the motion of screw 3 causes the pellets to melt. The melted polymer is then forced into mold cavity 7 via nozzle 6. The part is then formed and cooled within mold 8 and it hardens to the configuration of the mold cavity. Moveable platen 9 moves to the right so that the mold opens. The hardened part is then ejected.

Prior Art Fingernail Color Display Device

A prior art fingernail color display device is described in detail in U.S. Pat. No. 6,354,447 issued to Applicant on Mar. 12, 2002, which is incorporated herein by reference. The '447 patent shows a useful Z-shaped fingernail color display device 100 that displays pops 110 as shown in FIG. 1. While the device described in the '447 patent successfully functions as it fingernail color display device, it should be noted that it is somewhat expensive to make. Holes 108 have to be drilled and the Z-shaped base has to be formed. Also, pops 110 may become slightly askew while resting on stop section 104. It presents a neater appearance when all fingernail portions 210 are facing directly forward so that they are aligned properly with the front edge of holding section 106. The eye is immediately drawn to any pop that is slightly askew.

What is needed is a better and less expensive fingernail color display device.

SUMMARY OF THE INVENTION

The present invention provides a fingernail color display system. Holding rods, having a fingernail color display element, are inserted into a display device. The display device has a side section and a top section. The side section provides support for the top section. The top section has holes arranged in rows. Rod support sections are attached to the underside of the top section so that there are rows of the rod support sections. The holding rods are inserted through the holes and are supported by the rod support sections to display the holding rods so that a rearmost row is higher than a frontmost row. In a preferred embodiment, the display device is injection molded. Also preferably the top section is tilted with respect to horizontal and the rod support sections are of equal length. Also preferably the rod support sections include an alignment feature for aligning the holding rods so that the color display element is flush with the front edge of the display device.

DETAILED DESCRIPTION OF THE PREFERRED EMBODIMENTS

Figure 4:
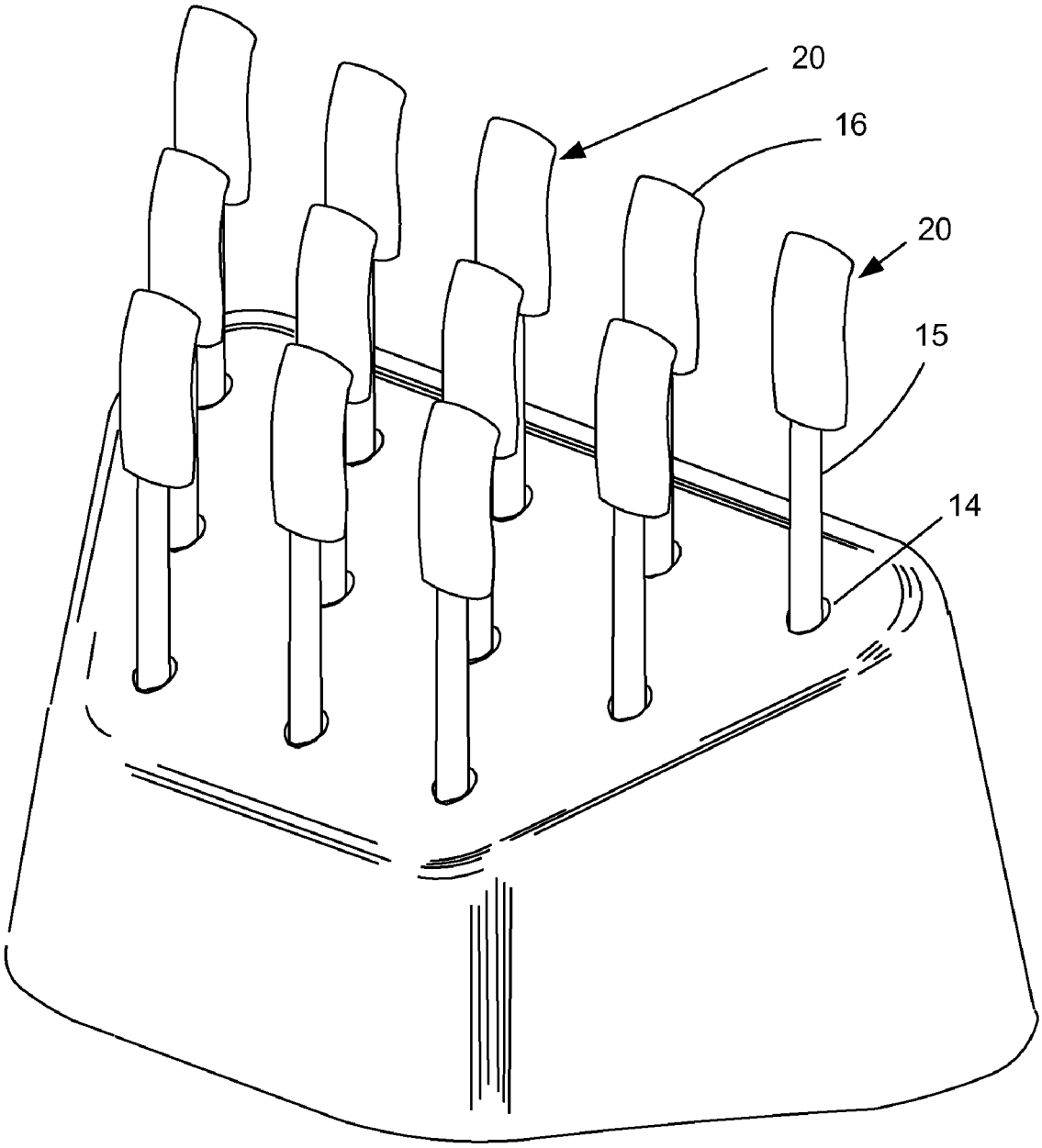
FIG. 4 shows artificial fingernail holders inserted into the embodiment shown in FIG. 2.

The present invention provides an improved fingernail display device. Display device 11 (FIG. 2) is formed in an automated, fast, and inexpensive manner by utilizing an injection molding process. A plurality of artificial fingernail holders 20 (FIG. 4) is displayed in a neat attractive fashion. Preferably display device 11 includes an alignment feature so that artificial fingernail holders 20 are appropriately aligned and uniformly facing forward as shown in FIG. 4.

Figure 1:
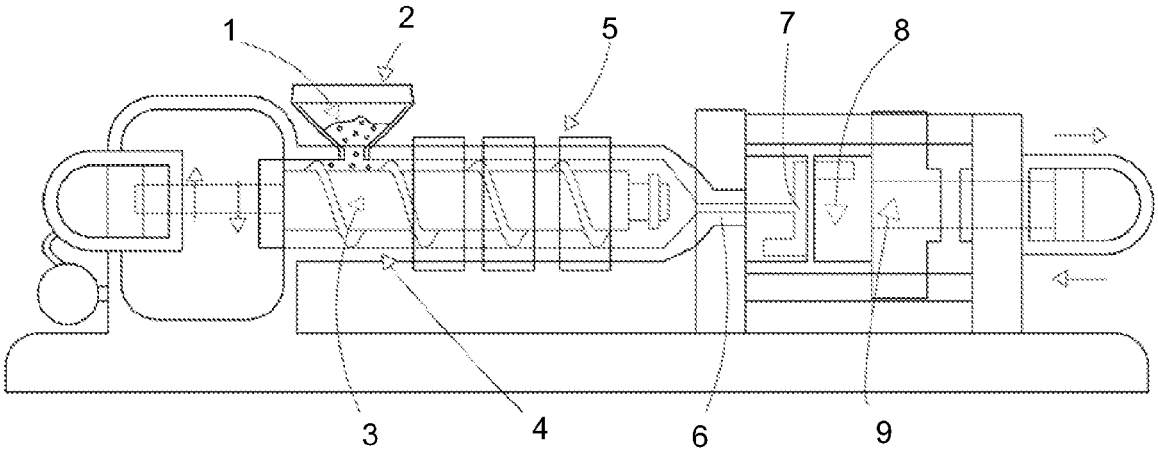
FIG. 1 shows a prior art injection molding process.
Figure 2:
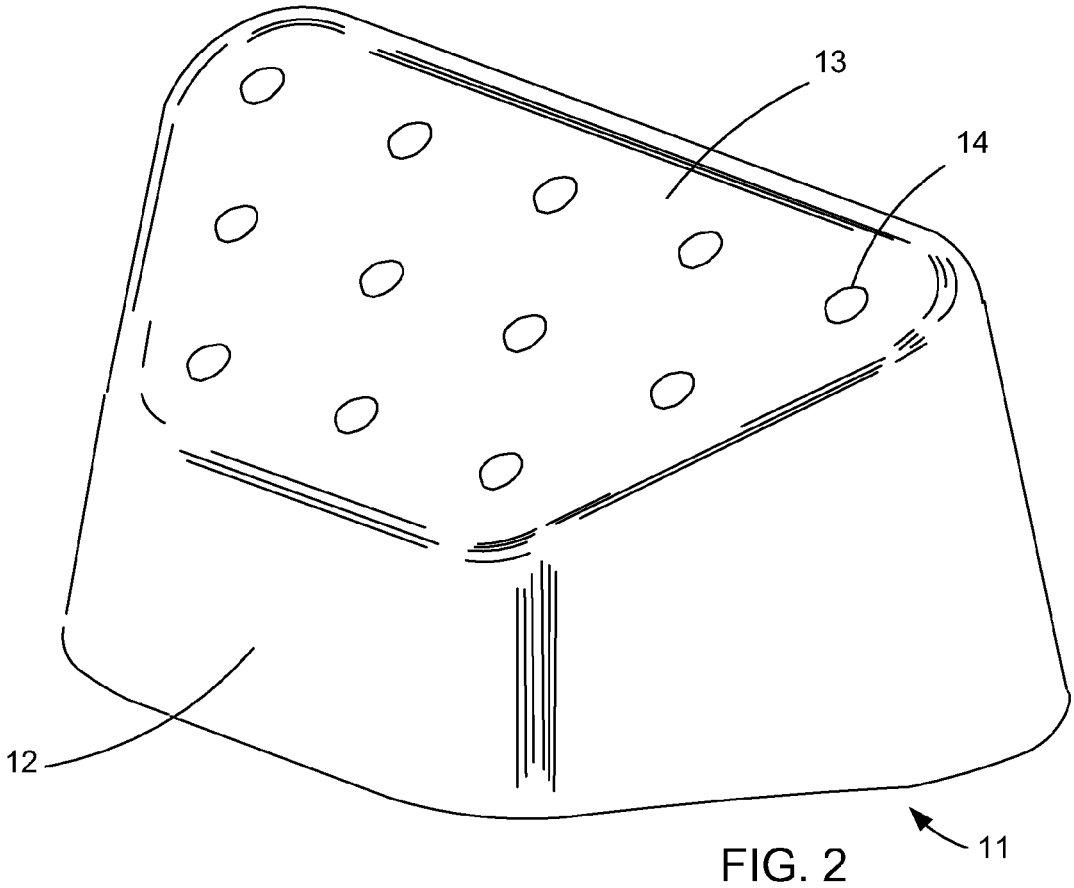
FIG. 2 shows a perspective view of a preferred embodiment of the present invention.

FIG. 2 shows a three dimensional view of a preferred embodiment of the present invention. In the preferred embodiment display device 11 is fabricated utilizing an injection molding process similar to that described in the Background section above. Display device 11 is preferably plastic and approximately 2 mm thick throughout. Display device 11 includes side support portion 12 and a tilted top portion 13. There is a plurality of holes 14 in top portion 13. Holes 14 allow for the insertion of rods 15 of artificial fingernail holder 20 having fingernail color display elements 16 (FIG. 3).

Figure 3:
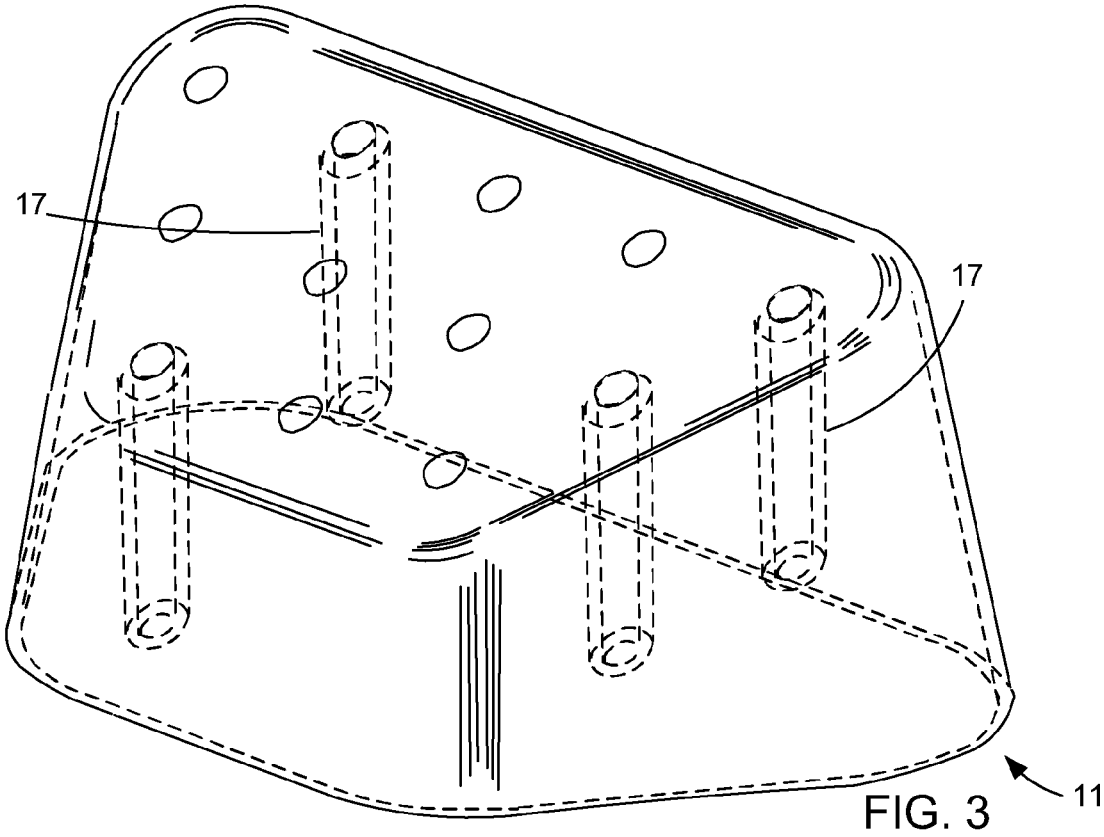
FIG. 3 shows additional features of the embodiment shown in FIG. 2.
Figure 5:
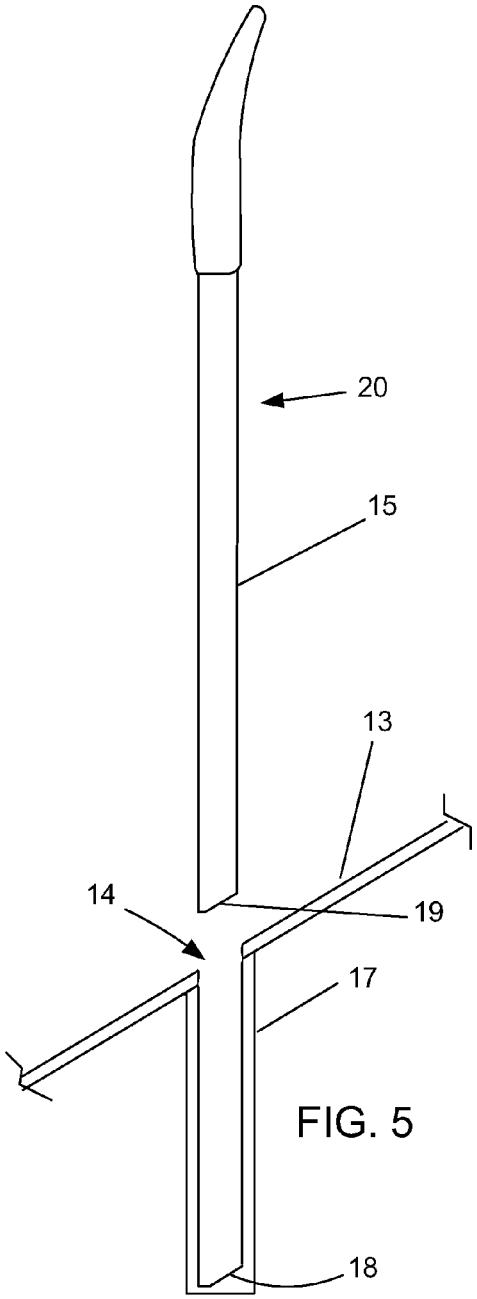
FIGS. 5-6 show a preferred rod support section.
Figure 6:
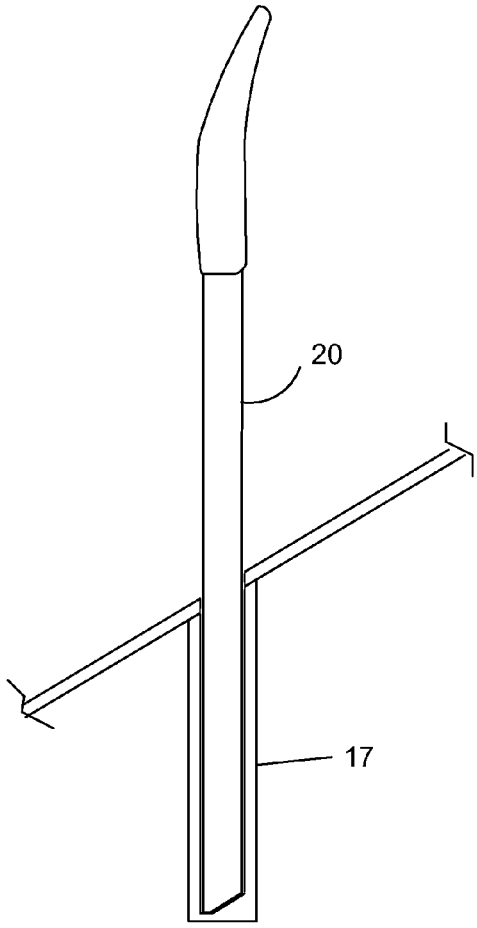

Extending downward from top portion 13 and under holes 14 is a plurality of cylindrically shaped rod support sections 17 (FIGS. 3, 5-6). Preferably, rod support sections 17 include an alignment feature so that fingernail color display elements 16 are automatically aligned so that they are facing forward and are appropriately aligned with the front edge of display device 11. For example, FIG. 5 shows slanted nub 18 at the bottom of rod support section 17. Rod 15 includes a corresponding slanted bottom 19 that aligns with slanted nub 18 when rod 15 is inserted into rod support section 17. Slanted nub 18 functions to hold artificial fingernail holder 20 steady and in a position so that fingernail color display elements 16 are aligned and facing forward, as shown in FIG. 6 and FIG. 4.

Cost Savings

Display device 11 is an exemplary device made quickly, inexpensively, and very effectively. The cost savings per device is very significant. Applicant states that the cost to fabricate device 11 via injection molding is approximately 95 cents per device. The compares to a cost of $5.00 for a fingernail display device shown in the '447 patent. This is a cost savings of almost 81 percent!

Other Methods and Materials for Forming Display Device

It was stated above that the preferred method for fabricating display device 11 was by utilizing an injection molding process. This is because the injection molding process is automated, fast and relatively inexpensive. Nevertheless, there are additional casting methods that could also be used to fabricate display device 11. For example slip casting, blow molding, vacuum forming, conventional machining, die casting, powder processing, and forging are methods that could likewise be used. Also although it was stated that the preferred material for the display device is plastic, it could be fabricated from other materials. Some other materials include glass, ceramics and metal alloys.

Figure 7:
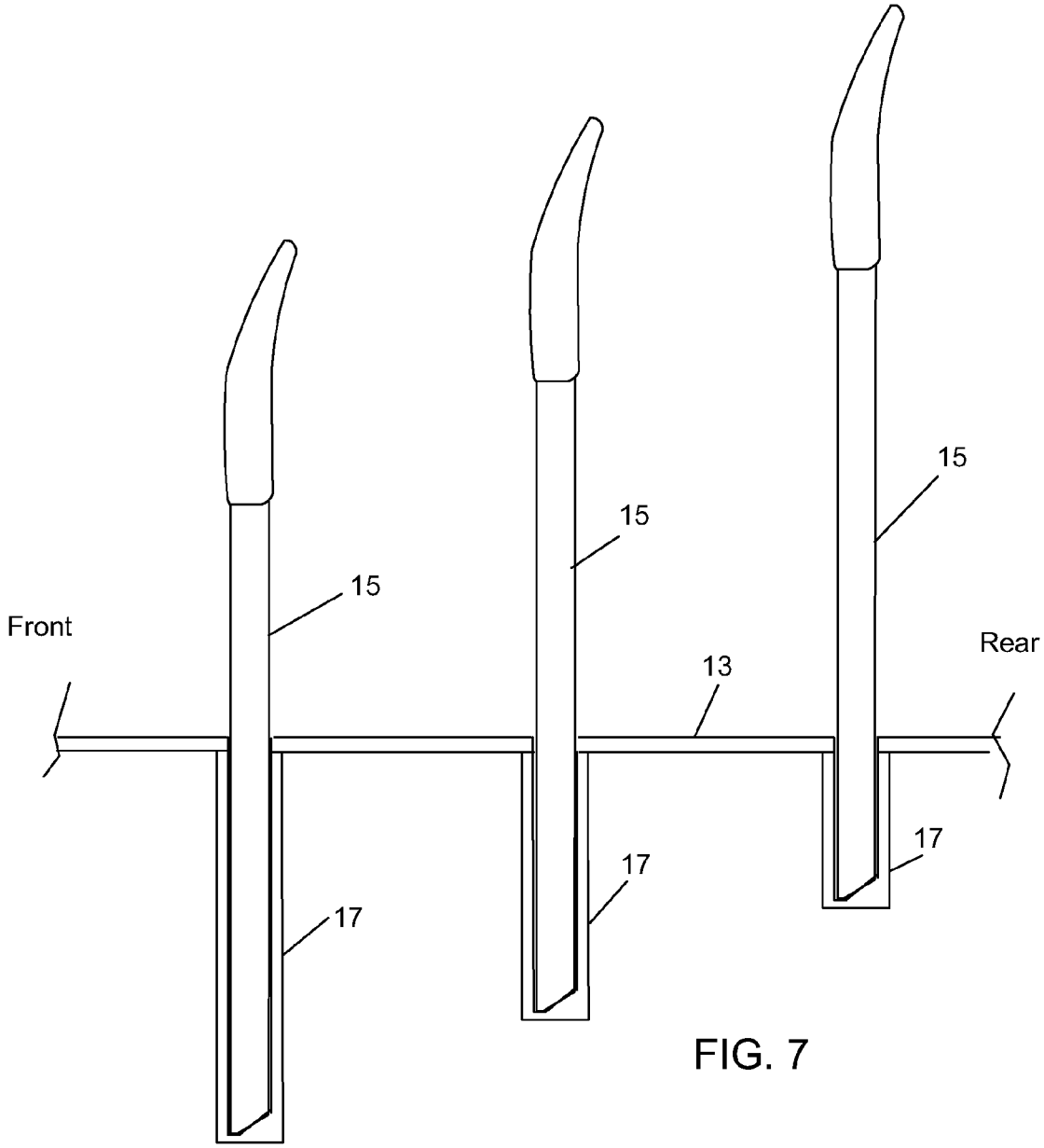
FIG. 7 shows another preferred embodiment of the present invention.

While the present invention has been described in terms of preferred embodiments, the reader should consider these described embodiments only as particular embodiments. Many other embodiments are possible. For example, it was already stated above that the present invention provides a fingernail color display device. In other words, by grabbing an artificial fingernail holder, a user can quickly put artificial fingernails of different colors over her own fingernails to determine an attractive color. Also, it should be noted that the fingernail holders can be painted artistically with nail art and displayed in display device 11. Nail art includes multicolored, artistically rendered patterns and designs painted onto the artificial nail portion at the end of the nail holder. Also, it should be noted that although it was shown in the preferred embodiment that top portion 13 was tilted forward, it is possible to make top portion 13 so that it is level (FIG. 7). In FIG. 7, rod support sections 17 become progressively shorter as they move towards the rear of top portion 13. By increasing the height of the artificial fingernail holders towards the rear of top portion 13, it makes it easier for a viewer to see all of the artificial fingernail holders. Also, although the preferred embodiment showed twelve holes 14, it would be possible to make the present invention with any number of holes desired. For example, in another preferred embodiment the display device has 30 holes (6 holes in the frontmost row, 7 holes in the next row back, 8 holes in the next hole back, and 9 holes in the rearmost hole). Therefore, the reader should determine the scope of the present invention by the claims and their legal equivalents.

What is claimed is:

1. A fingernail color display system, comprising:

A. a plurality of holding rods, each having a first end and a second end and a fingernail color display element connected to said first end of each rod, B. a display device, comprising:

(1) a side section, (2) a top section supported by said side section and having a plurality of holes extending therethrough, said holes being arranged in a plurality of rows, (3) a plurality of rod support sections rigidly attached to an underside of said top section and underneath said plurality of holes to form a plurality of rows of said rod support sections, (4) an alignment feature for aligning said plurality of holding rods in said display device so that said color display elements are held parallel to each other and uniformly face forward, wherein said second ends of said plurality of holding rods are inserted through said holes and are supported by said rod support sections to display said plurality of holding rods, wherein a rearmost row of said holding rods is higher than a frontmost row of said holding rods, wherein and said alignment feature prevents said plurality of holding rods from inadvertently rotating or spinning within said rod support sections.

2. The fingernail color display system as in claim 1, wherein said second ends of said plurality of holding rods comprise a slanted section, wherein said alignment feature comprises a slanted nub attached to the bottom of each of said plurality of rod support sections, wherein said slanted nubs mesh with said slanted sections of said second ends to align said plurality of display elements so that said color display elements are parallel to each other and uniformly face forward.

3. The fingernail color display system as in claim 1, wherein said top section is tilted relative to a horizontal plane from front to back, wherein said rod support sections are of equal length to one another.

4. The fingernail color display system as in claim 1, wherein said display device is fabricated utilizing an injection molding process.

* * * * *